US005731790A

United States Patent [19]

Riza

[11] Patent Number: 5,731,790

[45] Date of Patent: Mar. 24, 1998

[54] COMPACT OPTICAL CONTROLLER FOR PHASED ARRAY SYSTEMS

[75] Inventor: Nabeel Agha Riza, Orlando, Fla.

[73] Assignee: University of Central Florida, Orlando, Fla.

[21] Appl. No.: 552,092

[22] Filed: Nov. 2, 1995

[51] Int. Cl.[6] ..... H01Q 3/22; H01Q 3/24; H01Q 3/26

[52] U.S. Cl. ..... 342/368; 342/372

[58] Field of Search ..... 342/373, 372, 342/368; 359/238, 298

[56] References Cited

U.S. PATENT DOCUMENTS

| | | | |
|---|---|---|---|
| 4,725,844 | 2/1988 | Goodwin et al. | 342/374 |
| 4,739,334 | 4/1988 | Soref | 342/368 |
| 4,856,095 | 8/1989 | Rauscher | 455/619 |
| 5,093,563 | 3/1992 | Small et al. | 250/201.9 |
| 5,126,869 | 6/1992 | Lipchak et al. | 359/94 |
| 5,191,339 | 3/1993 | Riza | 342/372 |
| 5,253,033 | 10/1993 | Lipchak et al. | 356/5 |
| 5,274,381 | 12/1993 | Riza | 342/368 |
| 5,307,073 | 4/1994 | Riza | 342/372 |
| 5,333,000 | 7/1994 | Hietala et al. | 342/368 |

OTHER PUBLICATIONS

"Microwave Phase Shifter Using Optical Waveguide Structure," Matsumoto, et al., *Journal of Lightwave Technology*, vol. 9 No. 11, Nov. 1991, pp. 1423–1527.

"A Deformable Mirror–Based Optical Beamforming System for Phased Array Antennas" Toughlian, et al., IEEE *Photonics Technology Letters,* vol. 2, No. 6, Jun. 1990, pp. 444–446.

"Heterodyne Rception of Millimeterwave–Modulated Optical Signals with an in P–Based Transistor" Rauscher, et al., *IEEE Transactions on Microwave Theory and Techniques,* vol. 42 No. 11, Nov. 1994, pp. 2027–2034.

(List continued on next page.)

*Primary Examiner*—Theodore M. Blum

*Attorney, Agent, or Firm*—Brian S. Steinberger; Law Offices of Brian S. Steinberger

[57] ABSTRACT

A compact free-space/solid optics phased array antenna/transducer optical controller is disclosed that uses the principle of in-phase (I) and quadrature (Q) vector modulation via two dimensional (2-D) spatial light modulators (SLMs). The SLMs are used as distributed optical gain/amplitude control devices. The system can be fed by four independent lasers where one pair of lasers must be mutually incoherent (or their beat frequency is not in the interested spectrum) with the other pair of lasers. These lasers are modulated (directly or externally) by separate forms (different phase shifts: 0, 90, 180, 270) of the input source signal/modulated radio frequency (rf) carrier. Each of the four different sets of light beams (each set containing N light beams; N=Total antenna/transducer elements in phased array) is independently amplitude modulated by the 4X N modulating pixels of the SLM. Depending on the phase and amplitude of the carrier required on the nth antenna/transducer element, laser beams from any two of the four sets modulated by the nth pixel location of two of the N-element sub-areas of the SLM are optically combined in intensity via a photosensor (linear summation of rf signals). In a similar fashion, this can be independently done for all N elements of the phased array. The optical combining is done in a compact fashion, via free-space/solid optics or fiber-optics. In the preferred embodiment of the invention, a grey scale nematic liquid crystal SLM is used for amplitude modulation, although other SLMs can be used such as deformable mirror devices (DMDs), magnetooptic SLMs, multiple quantum well device SLM, and ferroelectric liquid crystal SLMs. An alternative embodiment uses a single high power laser light source that is split by a 1:4 optical power splitter into four light sources which are each coupled to four external optical modulators, wherein the original signal source has four externally modulated optical beams to form four light sources that act as inputs to the optical controller.

16 Claims, 7 Drawing Sheets

OTHER PUBLICATIONS

"General Microwave Full Line Atalog Components and Instruments," pp. 73–74.

"High–Optical–Isolation Low–Loss Moderate–Switching–Speed Nematic Liquid Crystal Optical Switch," Nabeel A. Riza, *Optics Letters* (1994) pp. 1780–1782.

"Acousto–Optic Liquid–Crystal Analog Beam Former for Phased–Array Antennas," Nabeel A. Riza, *Applied Optics*, vol. 33, No. 17, pp. 3712–3724 (10 Jun. 1994).

"A Photonic Integrated–Optic RF Phase Shifter for Phased Array Antenna Beam–Forming Applications," J. F. Coward et al., *Journal of Lightwave Technology*, vol. 11, No. 12, Dec. 1993, pp. 2201–2205.

"Photonic In–Phase/Quadrature Beam–Forming Network for Phased Array Antenna Applications," Coward, et al., *Optical Engineering*, Jun. 1993, vol. 32 No. 6, pp. 1298–1302.

COMPACT OPTICAL CONTROLLER FOR PHASED ARRAY SYSTEMS

This invention relates to optical controllers for phased arrays, and in particular to using the principle of in-phase(I) and quadrature(Q) vector modulation using two dimensional (2-D) spatial light modulators (SLMs) to control optical gain which results in radio frequency signal phase and amplitude control.

BACKGROUND AND PRIOR ART

An electronically controlled phased array antenna and transducer system is a smart form of a sensor that radiates energy such as electromagnetic, sound, pressure, acoustic waves, in the like, in any given direction and form via non-mechanical scanning. Currently, phased arrays are being used in a host of applications such as radars, communication antennas, ultrasound machines, sonar, and the like. It is clear that the phased array is "the" smart sensor of the future. Thus, the need exists to make these antenna and transducer systems affordable and multipurpose.

Currently, electronic control systems are used for phased arrays. These electronic controllers are very expensive, large, heavy, frequency sensitive and EMI(electromagnetic interference) prone. Recently, the use of optics has been proposed for controlling phased arrays. With optics, much smaller control systems are possible as discussed in the next section. In addition, optics could provide a cost benefit when going to larger arrays (>100 elements). Large arrays are required in high resolution systems.

Optical control systems for phased arrays have been proposed for both time delay and modulo-$2\pi$ phase-based systems such as systems described in "Optoelectronic Signal Processing for Phased Array Antennas," edited by B. M. Hendrickson, January 1994 SPIE Proceedings.

The subject invention is a phase-based system having a narrowband operation (i.e., a few percent of the carrier). Previous phase-based controllers have generally relied on optical phase shifts introduced via SLMs in optical interferometers as described in the inventor's U.S. Pat. No. 5,191,339 and the article entitled: "A Deformable Mirror-Based Optical Beamforming System for Phased Array Antennas," Toughlian et al., IEEE Photonic Tech. Lett., Vol.2, no.6, 1990, pages 444–446. Other phase-based controllers have generally relied on integrated optical waveguide electrooptic phase shifts in integrated optic Mach-Zehnder interferometers to generate the required rf phase shifts. See for example, Matsumote et al., "Microwave Phase Shifter Using Optical Waveguide Structure", IEEE/OSA Journal of Lightwave Tech., Vol.9, No.11, November, 1991, pages 1523–1527. Depending on the application environment, these systems can be extremely sensitive to mechanical vibrations on a sub-micron scale.

It is well known in the rf community that I-Q vector modulators can be used to form programmable rf phase shifters and amplitude trimmers. See for example, "General Microwave Corp. Series 71, 12 bit digital and Series 72 Analog I-Q Vector Modulators, page 73, General Microwave Corp. Catalog, 1994.

FIG. 1 illustrates a typical prior art rf I-Q vector modulator 100 that generates an rf output 190 with the correct phase shift and amplitude values based on the operation of the bi-phase modulators 112, 114(A bi-phase modulator puts either a 0 or 180 degree phase shift on the rf signal). The control signals 122, 124 to the pair of bi-phase modulators 112, 114 determines the strength or amplitude level/attenuation of the bi-phase modulated rf signals which are combined by an In-Phase Combiner 118, 119 to give the selected rf output signal 190. The amplitude level of the signals 113, 115 output from the bi-phase modulators determines the net phase shift and amplitude of the eventual output rf signal 190.

Recently, an integrated-optic (IO) analog of the rf I-Q phase shifter has been proposed using the intrinsic modulation and biasing properties of integrated-optic Mach-Zehnder amplitude modulators (MZAMs). See for example Coward et al. "Photonic in-phase/quadrature beamforming network for phased array antenna applications", Optical Engineering, Vol. 32, No. 6, June 1993, pages 1298–1302 and Coward et al. "A Photonic Integrated-Optic RF Phase Shifter for phased array antenna beamforming applications", IEEE/OSA Journal of Lightwave Tech., Vol. 11, No. 12, December 1993 pages 2201–2205.

FIG. 2A is a prior art integrated optic I-Q vector modulator(phase shifter) 210 using two lasers. Referring to FIG. 2A, IO photonic I-Q device 210 includes two independent variable gain controlled lasers 212, 222 such as 1300 nm semiconductor laser diodes, controlled via two amplifiers 212.1 and 222.1. The two output laser beams feed two mach-zehnder amplitude modulators(MZAMs) that are further coupled to a integrated optic fiber 2:1 (IO) coupler 240 that couples to a fiber 242 and detector 244. The MZAMs 214, 224 are electrically driven by lines 231, 232 via an rf 90 degree hybrid coupler 230. Thus, for each antenna element in a phased array antenna/transducer system, a separate IO photonic I-Q device 210 is required that contains in all 8 separate components (not including the fiber 242 and detector 244).

This means that for an N-element phased array, N IO photonic I-Q devices 210 are required with a total of N×8 components/subcomponents. For a typical microwave radar with 3000 elements, a total of 24,000 components is needed. Thus, the total cost and interconnection nightmare, and the varied non-linear effects from the MZAMs, along with the varying path lengths caused by the use of the many element level hybrid couplers are extremely elaborate and problematic. Furthermore, the possibility of a calibration nightmare for the entire system exists with such a large and complex system.

FIG. 2B is a prior art integrated optic I-Q vector modulator(phase shifter) 260 using one laser 262, where four MZMs 264, 266, 274, 276 are used. MZMs 264 and 274 optically control the amplitude of the two laser beams from the single laser. As such, MZMs 264 and 274 replace the electrical amplifiers 212.1 and 222.1 in the previous prior art module 210. It is noted that the prior art integrated optic I-Q vector modulator(phase shifter) 260 also includes eight(8) subcomponents per I-Q module.

Thus, the need exists to substantially reduce the number of components used in optical control systems to a manageable number which in turn would reduce the number of calibration errors.

SUMMARY OF THE INVENTION

The first objective of the present invention is to provide an optical controller having a simple and compact/lightweight (shoe-box) system design with approximately a dozen or less components. Thus the system is portable, remoteable, and easily repairable.

The second object of this invention is to provide an optical controller that is relatively insensitive to desired carrier frequency of operation. In other words, there is only the need to change the three hybrids in the system, assuming the optical modulation and detection devices have a very wide frequency of operation. Thus, there is no need to change the SLM.

The third object of this invention is to provide an optical controller where any reflective, transmissive, absorptive, etc. mechanism SLM can be used in the invention with simple optical design changes. The application will determine the SLM switching speed and grey scale requirements.

The fourth object of this invention is to provide an optical controller system that can be equally used for both transmit and receive phased arrays by using local oscillator (LO) based receive processing described in the subject inventors article entitled: Acousto-optic Liquid-Crystal Analog Beam Former For Phased-Array Antennas, Applied Optics, Vol. 33, No. 17, 10 June 1994, pages 3712–3724, and in U.S. Pat. No. 4,856,095 to Riza, which is incorporated by reference. Here, the photo-sensor can be used to act as a down-converter (if used as a three-terminal device described in U.S. Pat. No. 4,856,095 to Rauscher, thus causing the received signal to be mixed with the replica of the transmit LO that is generated by the optical system.

The fifth object of this invention is to provide an optical controller having low (e.g.,<100 mW) control power overhead due to low capacitance requirements of SLMs.

Various types of simple spatial techniques can be used to reduce coherent mixing effects in the system. These include the use of bulk polarization components and orthogonally (linear) polarized laser beams for optical summation, or the use of moving diffusers to randomize the phase of the combining light beams, or the use of two mutually temporally incoherent lasers. This ensures that the summing laser beams do not coherently mix to generate beat signals.

A primary object of the subject invention is to develop a compact, low cost optical controller that also relies on the I-Q vector modulation principle, but does away with the 1000s of IO components, and uses instead a few bulk optical components. For example, the preferred embodiment of the invention uses one SLM, four lasers and their high speed analog modulation optics and electronics, three rf hybrids, four lenses, three beam combiners, and three beam reflectors. An advantage of this system is that regardless of the number of antenna elements N (within certain design constraints), the number of bulk components remains the same, and only the pixel count in the SLM changes. In addition, the hardware can be frequency insensitive in that only the three rf hybrids and perhaps the modulation electronics of the four lasers needs to be changed when changing the frequency of operation of the phased array system. This is unlike the IO I-Q approach where a 1000 hybrids need to be replaced for a 1000 element system, along with a 1000 MZAM electronics. In other words, in prior art systems one has to design a new system for essentially every different frequency range. Another object of the subject invention is to substantially reduce the amount of system calibration needed since there are fewer points of calibration error.

Further advantages with this novel system include low electromagnetic interference(EMI), higher protection from electromagnetic pulses(EMP), and fiber-remoting capabilities.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIGS. 3A–3D illustrates the four cases how an I-Q Vector Modulator can generate 0–360 degree phase shifts for an input rf carrier, in addition to providing amplitude control. A key principle behind the I-Q technique is the weighted summation of two phase sited signal replicas where the relative weight of the adding signals controls the phase and amplitude of the resultant vector sum signal. Thus, for each carrier signal to be controlled and generated, we need a pair of signal amplitude attenuators with excellent grey scale control. Thus, for a 1000 element antenna, we need 2000 variable gain amplifiers in the 1000 I-Q vector modulators. As shown in FIGS. 3A–3D, in order to get full 0–360 degree phase control, we need another pair of amplitude trimmer sets. In other words, for a 1000 element array, we need 4×N=4000 amplitude control grey scale devices. In the subject invention, we show that this amplitude control operation can be done in a single postage stamp size chip/SLM such as a nematic liquid crystal (NLC) 2-D SLM, which like commercial liquid crystal computer displays and wrist watches is a low cost (e.g., $2,000) device. The inventor has previously demonstrated experimentally that NLCs can give over seven bits of grey scale control (See Riza, "Acousto-optic Liquid Crystal Analog Beamformer for Phased Array Antenna", Vol. 33, No. 17, June 1994, Applied Optics, pages 3712–3724.

The subject inventor has further demonstrated the potential of achieving over twelve bits of dynamic range (e.g., 5000:1 or 36 dB on/off optical attenuation or 72 dB of rf signal-to-noise ratio) in other experiments. See Riza, "High Optical Isolation Low Loss Moderate Switching Speed Nematic Liquid Crystal Switch", Optics Letters, Vol. 19, No. 21, November 1994, pages 1780–1782.

Referring to FIGS. 3A–3E, phrase "BPM", is defined as "Bi-phase Modulator is set to preselected degrees." Acronym "VGA" refers to Variable Gain Amplifiers and Signal Amplitude Control Devices. The function "c(t) sin (wt)" refers to Signal Modulation c(t) on a carrier sin(wt).

In order to obtain full 0–360 degree phase control for the N rf signals, plus grey-scale amplitude control, we must optically implement the signal flow chart operations illustrated in FIGS. 3A–3D.

FIRST PREFERRED EMBODIMENT

Figure 1:
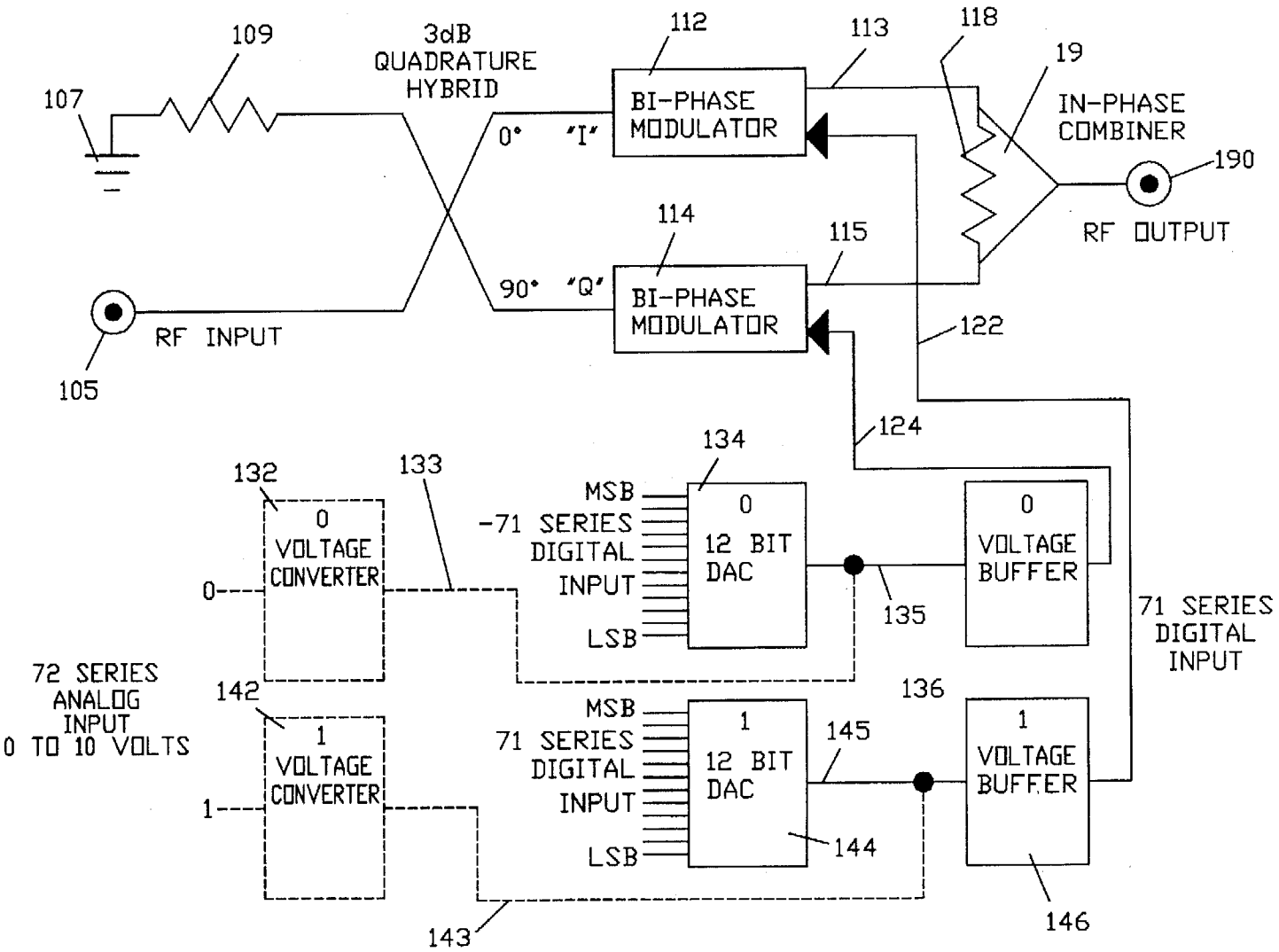
FIG. 1 is a prior art block diagram of a typical Electrical I-Q Vector Modulator.
Figure 2A:
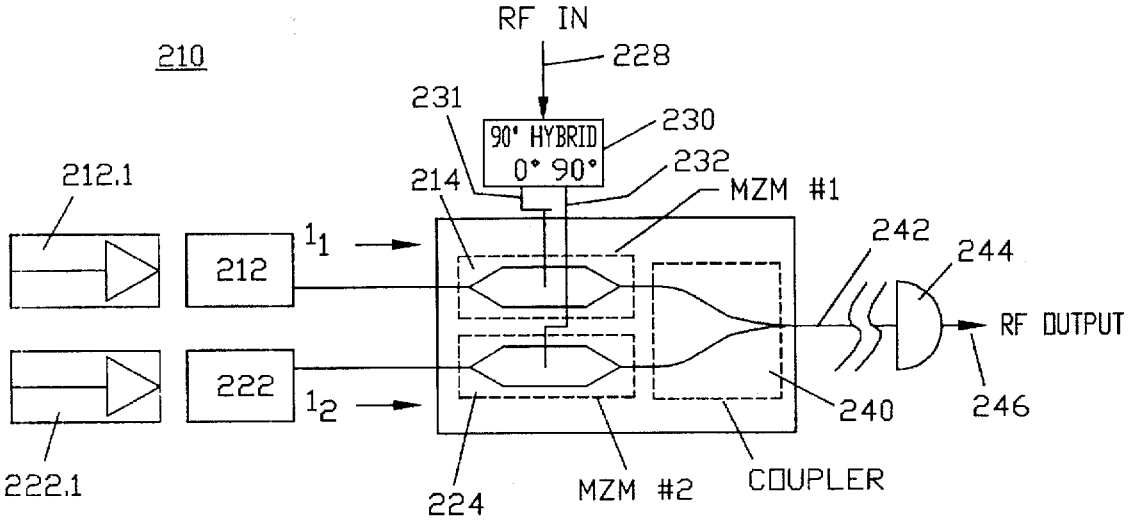
FIG. 2A is a prior art integrated optic I-Q vector modulator(phase and amplitude control) using two lasers.
Figure 2B:
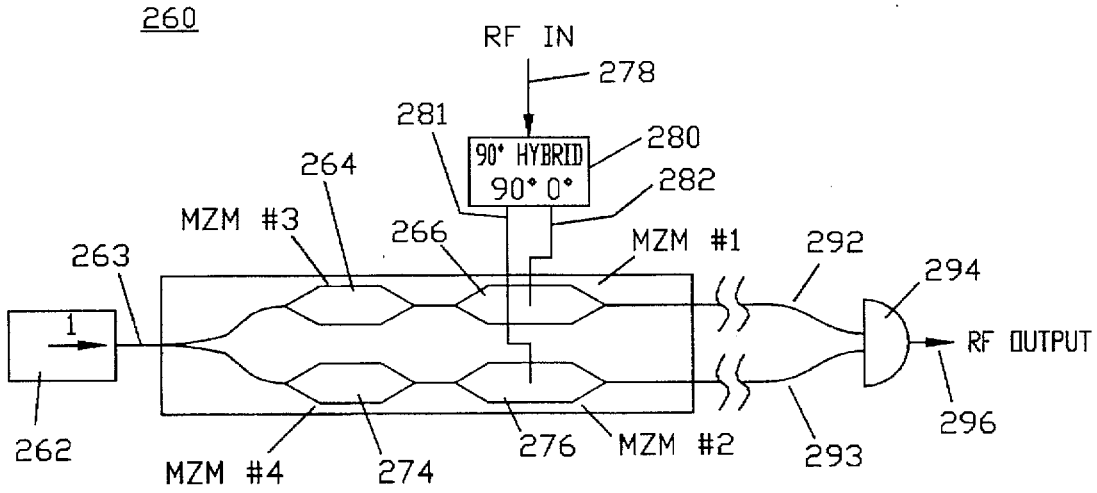
FIG. 2B is a prior art integrated optic I-Q vector modulator using one laser.
Figure 3A:
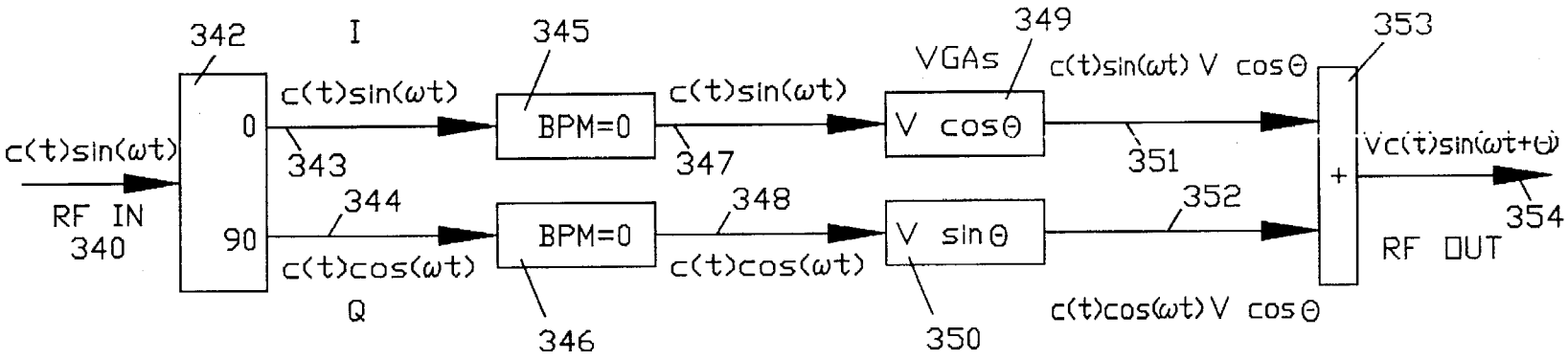
FIG. 3A illustrates a first case of the I-Q vector modulator operation according to the invention.
Figure 3B:
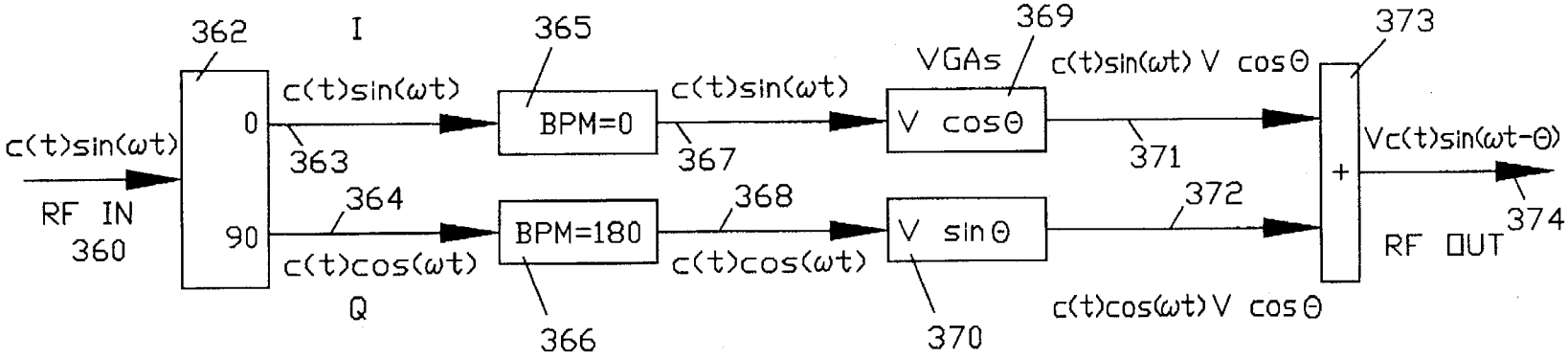
FIG. 3B illustrates a second case of the I-Q vector modulator operation according to the invention.
Figure 3C:
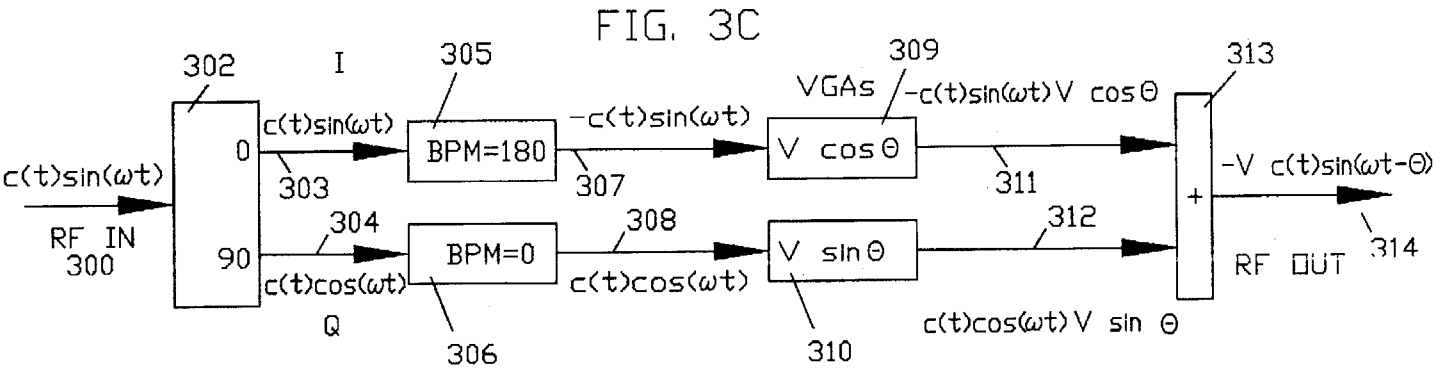
FIG. 3C illustrates a third case of the I-Q vector modulator operation according to the invention.
Figure 3D:
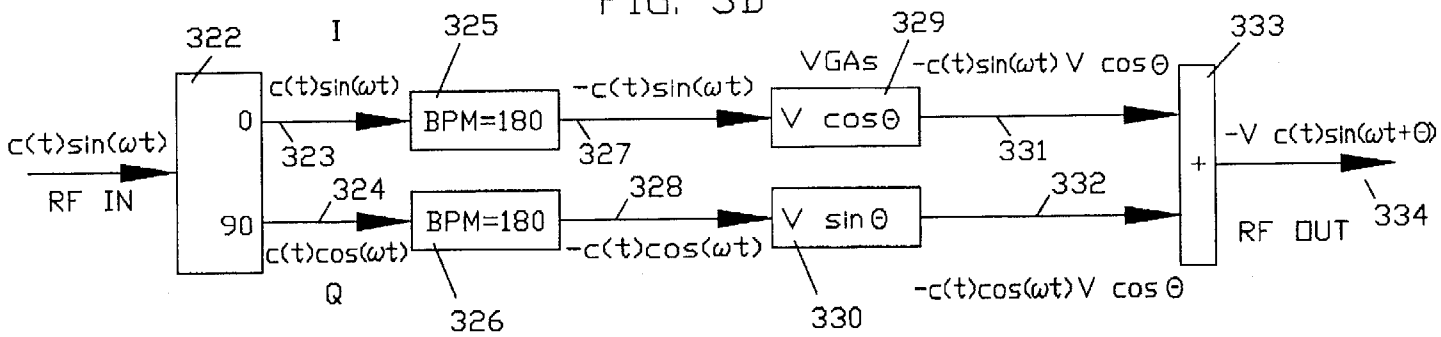
FIG. 3D illustrates a fourth case of the I-Q vector modulator operation according to the invention.
Figure 3E:
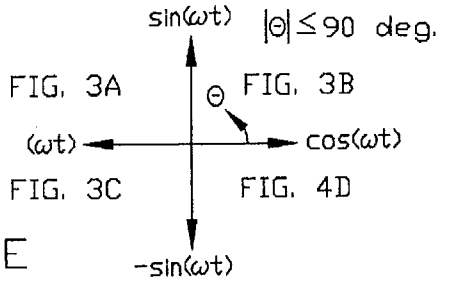
FIG. 3E shows the signal phase and amplitude control format of four cases of FIGS. 3A–3D in one diagram.
Figure 4:
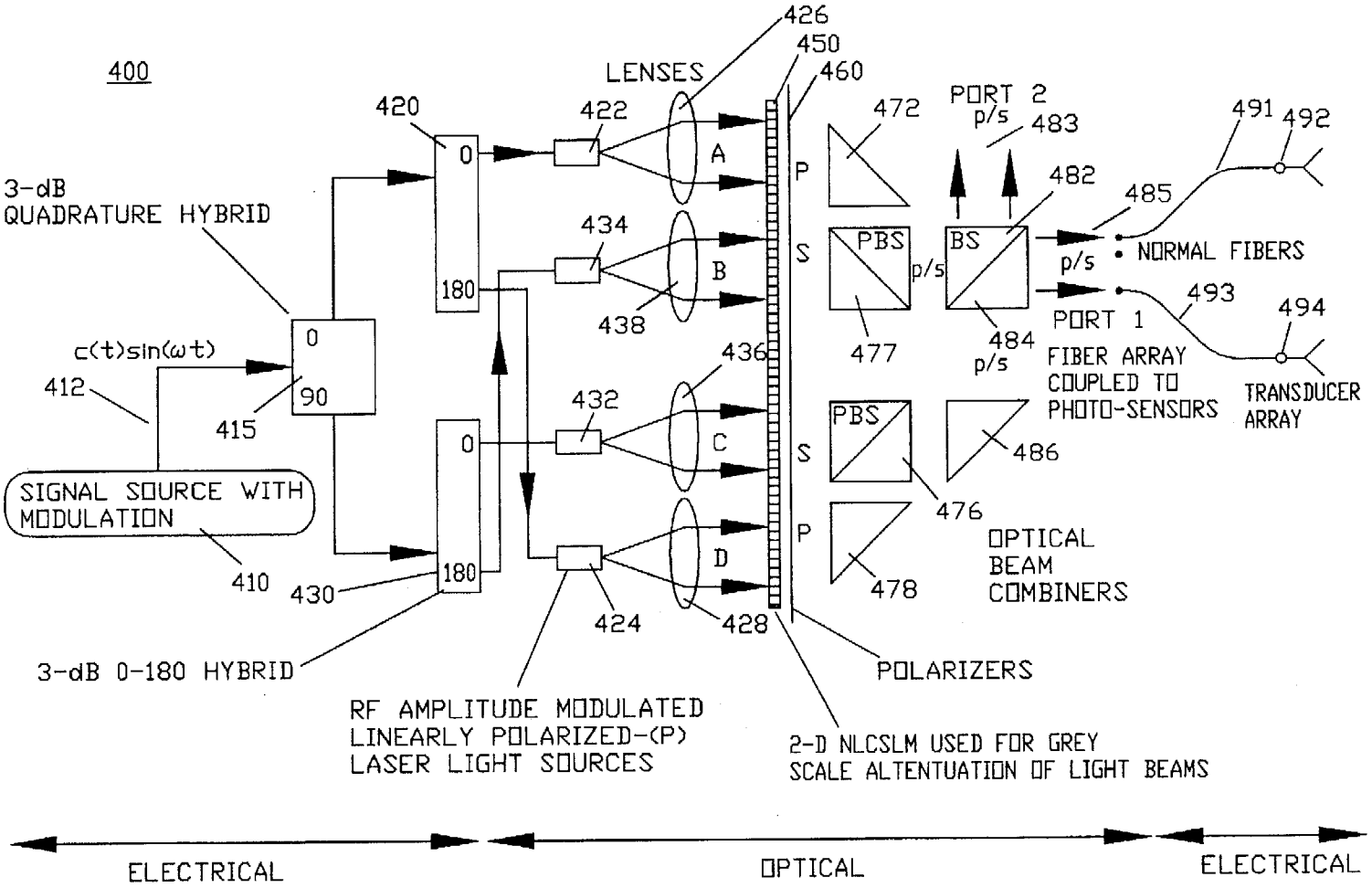
FIG. 4 illustrates a first preferred embodiment of the novel compact controller for phased array systems using one SLM for the optical attenuation operation.

FIG. 4 illustrates a first preferred embodiment 400 of the novel compact controller for phased array systems using one SLM for the optical attenuation operation. Note that four different sets of intensity modulated light, that is, sets labelled A, B, C and D, are incident on their respective N pixel areas on the SLM. Here the phased array has N elements; thus the SLM has four times N pixels. In order to generate a signal with the correct phase and amplitude for the nth element in the array, a combination of two light beams from only two of the sets is required. In other words, A+C (case 1:2nd quadrant) or A+B (case 2:1st quadrant) or D+C (case 3:3rd quadrant), or finally D+B (case 4:4th quadrant). Thus, if A+C is required, then the light from the nth pixel in sets B and D are not required and should be fully attenuated (i.e, these nth pixels should be turned fully off so no light passes through into the beam combining system).

Referring to FIG. 4, polarization is used as the basic principle for attenuating and combining the light beams. Attenuation is achieved via an NLC SLM (twisted nematic or parallel-rub birefringent mode). The system is designed so that any two beams per pixel optically combining at the photo-sensor have orthogonal polarizations. For example, the beams from set A are p-polarized (vertical) while the beams from sets B and C with which A can combine are s-polarized (horizontal). Because the polarizations are orthogonal, undesired coherent mixing effects are minimized. This a vital feature of this invention since linear summation of light beam intensities is required at the optical sensor to give a linear summation of electrical signal components. In other words the two light beams must be mutually incoherent to minimize coherent mixing effects or their beat signal must be out of the range of photo-sensor/phased array feed system. In the subject invention, there are various ways to achieve this mutual in-coherence. Here, only two laser sources have to be mutually incoherent. In other words, the same laser can feed the two independent optical modulators that generate light beam sets A and D. Similarly, one laser can generate sets B and C. This is because on any nth photosensor the operations A+D and B+C never happens (only the four cases mentioned earlier happen). In fact, if we use the polarization controlled embodiment in FIG. 4, we could use a single high power (>100 mW) laser feeding four external optical modulators; thus preventing coherent mixing effects because of the use of orthogonal polarization detection.

Thus by adjusting the grey level attenuation controlled via the SLM, any phase and amplitude can be generated by the proposed invention.

Referring to FIG. 4, a signal source with modulation 410 provides a signal c(t) sin(wt) along an electrical wire line 412. The signal 412 can have a frequency (ω) of approximately 100 GHz. The signal can pass to an electrical 3-dB quadrature hybrid, 415, which passes the signal to respective 3-dB 0–180 Hybrids 420 and 430. Hybrid 420 controls laser light sources 422 and 424, while hybrid 430 controls light sources 432 and 434. Laser light sources 422, 424, 432 and 434 can be 200 mw semiconductor laser diodes that operate at approximately 780 nm. Referring again to FIG. 4, the resulting signal is focussed through respective lens 426, 428,436, 438 and into a 2-D nematic liquid crystal(NLC) spatial light modulator(SLM) 450 used for grey scale attenuation of incoming light beams. Alternatively, SLM 450, can be a deformable mirror device(DMD), a magnetooptic SLM, a ferroelectric liquid crystal SLM, or a multiple quantum well device SLM.

The function and operation of polarizing beam splitters 474, 476, beam splitter 482, port 2, 483, optical beam combiners 478, and total internal reflection prism 486, port 1,485 is to recombine and align the desired N beam pairs with the N-element fiber/photosensor array that generates the electrical signals to control the phased array. Optical fibers 491, 493 represent portions of a fiber array coupled to photo-sensors which are part of a transducer array 492, 494.

SECOND PREFERRED EMBODIMENT

Figure 5:
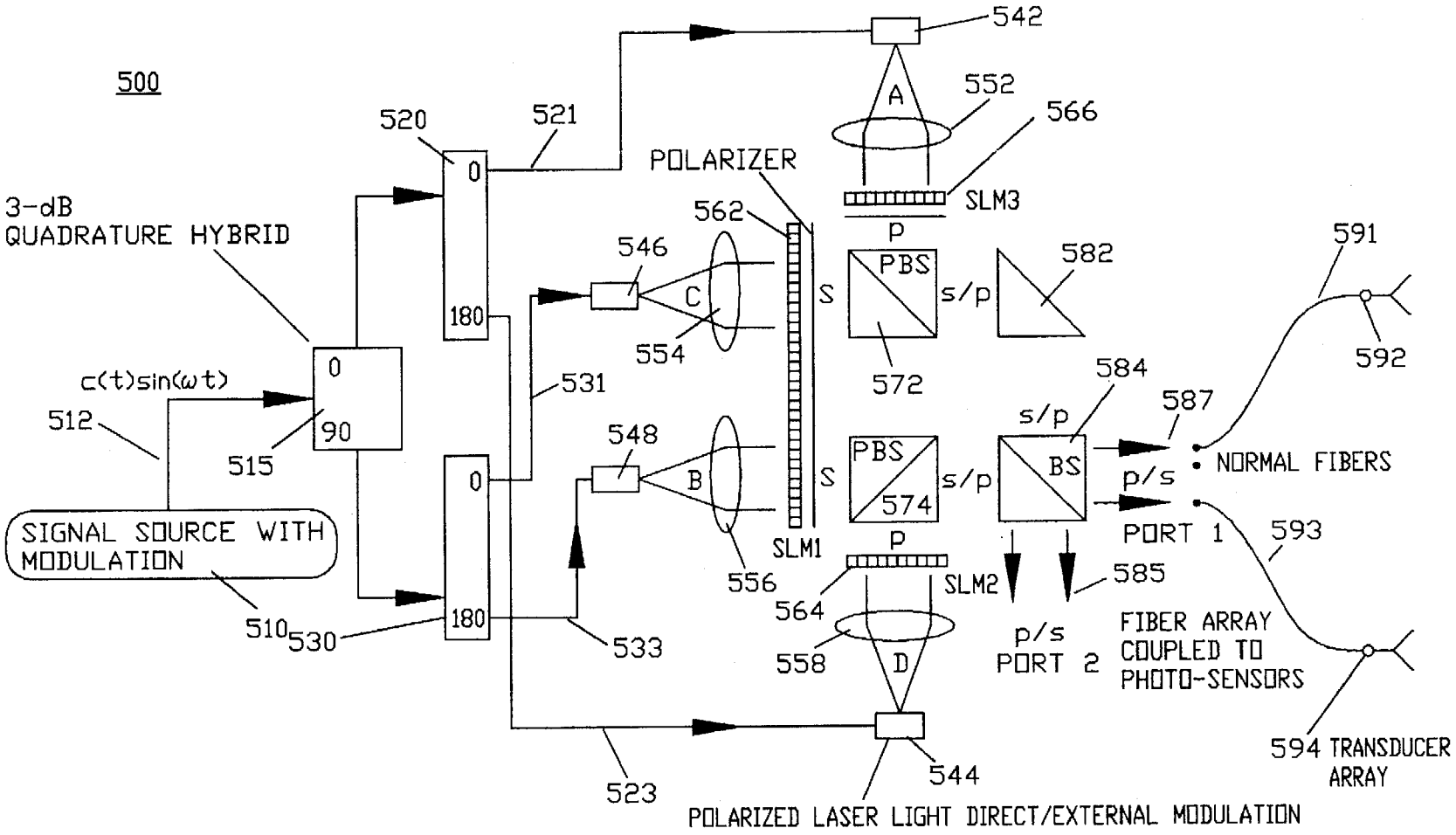
FIG. 5 illustrates a second preferred embodiment of the novel compact controller for phased array systems using three spatially separate SLMs with improved optical path length compensation.

FIG. 5 illustrates a second preferred embodiment 500 of the novel compact controller for phased array systems using three separate spatial SLMs with improved optical path length compensation. The optical path-difference compensation in FIG. 5 is better than in FIG. 4. This means that the two optical beams that form the summation on the photo-sensor travel approximately the same overall path length. In other words, there is no relative delay between the adding optical signals. This is particularly important when the signal frequency (ω) is greater than approximately 10 GHz, as 360 degree phase shifts correspond to shorter optical delays.

When rf carrier frequencies get high into the mm-wave range, the slight optical path differences in the optical sets A and C, or A and B, or D and C, or D and B, can cause an unwanted phase error. Ideally, there should be no path difference. Referring to FIG. 5, the combinations A+C and B+D have no path differences. For the other two cases, the path difference is equal to a cube side or approximately 0.1 ns for a three cm side cube. It is possible to use other optical designs to minimize this path difference problem, such as but not limited to optical birefringent(two indexes) plates in the optical paths.

Note that the proposed system has two output ports at 585 and 587 in FIG. 5, and either one or both can be used. In order to avoid a 50% optical loss, the outputs from the two ports 585, 587 can be combined using fiber-optic couplers. The overall system using one port has an optical efficiency of 25%.

Referring to FIG. 5, a signal source with modulation 510 provides a signal c(t) sin(wt) along an electrical wire line 512. The signal 512 can have a frequency(ω) of approximately 100 GHz. The signal can pass to an electrical 3-dB quadrature hybrid, 515, which passes the signal to respective 3-dB 0–180 Hybrids 520 and 530. Hybrid 520 controls laser light sources 542 and 544, while hybrid 530 controls light sources 546 and 548. Laser light sources 542, 544, 546 and 548 can be 200 mw semiconductor laser diodes that operate at approximately 780 nm. Referring again to FIG. 5, the resulting signal is focussed through respective lens 552, 554, 556 and 558 and into three respective 2-D nematic liquid crystal(NLC) spatial light modulators(SLM) 562, 564, 566 used for grey scale attenuation of incoming light beams. Alternatively, each of the SLMs 562, 564, 566 can be a deformable mirror device(DMD), a magnetooptic SLM, a ferroelectric liquid crystal SLM or a multiple quantum well device SLM.

Again, the function and operation of polarizing beam splitters 572, 574, beam splitter 584, port 1 587, optical beam combiners 582, and port 2, 585 is to recombine and align the N beam pairs with the N-element fiber/photosensor array. Optical fibers 591, 593 represent portions of a fiber array coupled to photo-sensors which are part of a transducer array 592, 594.

Figure 6:
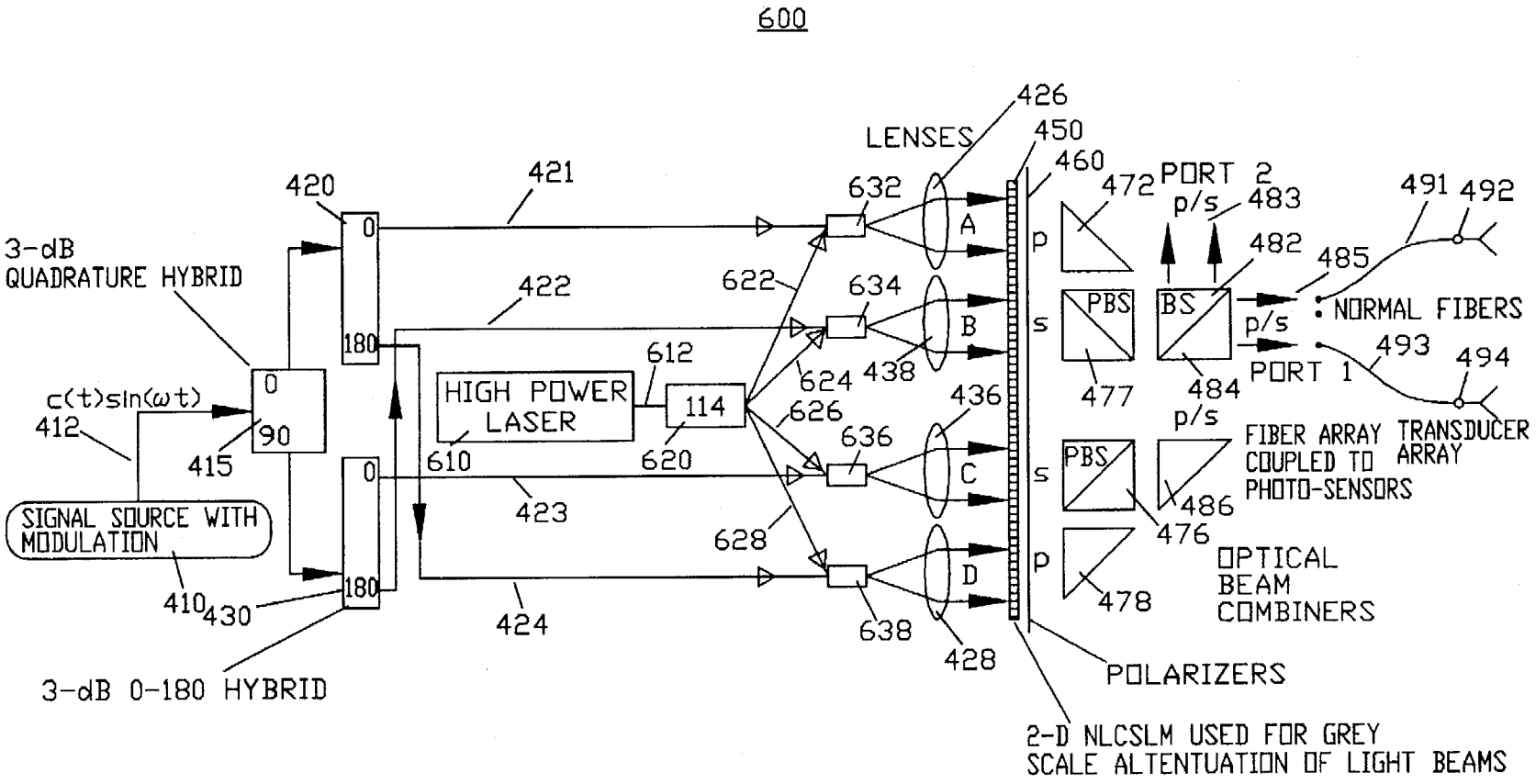
FIG. 6 is a third preferred embodiment of the novel compact controller for phased arrray systems using the single SLM configuration of FIG. 4 with one high power laser.

FIG. 6 is a third preferred embodiment 600 of the novel compact controller for phased array systems using the single SLM configuration of FIG. 4 with a single high power laser(e.g. greater than approximately 200 mW). High power laser 610 emits a light source by a fiber or through free-space feed 612 into a 1:4 ratio optical power splitter, 620 which splits the laser emitted light onto four optical fibers or through four free-space feeds 622, 624, 626, 628 and into respective external optical modulators 632, 634, 636, 638, such as bulk electro-optic modulators or alternatively integrated electro-optic modulators using Lithium Niobate material. Note that the bulk devices can be free-space optically connected to respective components while the integrated modulators can be optical fiber connected to respective components. The remaining labelled components in FIG. 6 are described in relation to the description of FIG. 4. Referring to FIG. 6, the single laser source 610 has four external modulated optical beams by modulators 632–638 in order to form four light sources that act as inputs to the optical controller components 45+.

The above described invention is a control system for a phased array system. The operation frequency of this controller can include the approximate ranges from the milli-Hertz region all the way up to 100 Ghz and beyond (as we are using a narrowband modulation with respect to the optical frequency of approximately 1000,000 GHz). The subject invention can have a wide range of applications such as but not limited to: military phased array radars, air traffic phased array radars, satellite communication phased array antennas, cellular base-station or mobile communication phased array antennas, medical ultrasound phased arrays, industrial non-destructive testing ultrasonic phased arrays, acoustic microscopy, sonar arrays, weather phased array radars and atmospheric characterization instruments, communication antennas, radio astronomy array antenna phased array direction finders and frequency sweepers, adaptive phased array beamformers, and narrowband array processing and traversal filtering.

Although the preferred embodiments describe using NLC (nematic liquid crystal) as the SLM(Spatial light modulator), other SLMs such as ferroelectric liquid crystal SLMs, deformable mirror device SLMs, magneto-optic SLMs, and multiple quantum well(MQW) SLMs can be used.

While the embodiments describe electrical array transducer systems via a novel optical polarization independent controller, other optical systems such as but not limited to reflective, absorptive, polarization independent, and the like can also be incorporated in the subject invention.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A compact, low cost optical controller system for controlling transducer arrays that uses in-phase(I) and quadrature(Q) vector modulation via compact bulk optics for significantly reducing the number of components resulting in the system comprising:

a signal source having a frequency (ω)

a spatial light amplitude modulator(SLM);

a first laser light source modulated by the signal source inputting to the SLM and outputting a first output beam;

a second laser light source modulated by the signal source inputting to the SLM and outputting a second output beam;

a third laser light source modulated by the signal source inputting to the SLM and outputting a third output beam;

a fourth laser light source modulated by the signal source inputting to the SLM and outputting a fourth output beam; and a beam combiner for combining the first output beam, the second output beam, the third output beam and the fourth output beam to a photosensor array that feeds to a transducer array.

2. The compact, low cost optical controller system of claim 1, wherein the SLM includes:

a grey scale nematic liquid crystal(NLC) SLM.

3. The compact, low cost optical controller system of claim 1, wherein the SLM includes:

a deformable mirror device(DMD).

4. The compact, low cost optical controller system of claim 1, wherein the SLM includes:

a magnetooptic SLM.

5. The compact, low cost optical controller system of claim 1, wherein the SLM includes:

a multiple quantum well device SLM.

6. The compact, low cost optical controller system of claim 1, wherein the SLM includes:

a ferroelectric liquid crystal (FLC) SLM.

7. The compact, low cost optical controller system of claim 1, wherein the transducer array includes at least one of:

a transmitting array and a receiving array.

8. The compact, low cost optical controller system of claim 1, wherein the signal source includes:

a signal having a frequency (ω) of approximately 100 GHz; and wherein the first laser light source, the second laser light source, the third laser light source and the fourth laser light source each include:

200 mw semiconductor laser diodes operating at approximately 780 nm.

9. A compact, low cost optical controller system for controlling transducer arrays that uses in-phase(I) and quandrature(Q) vector modulation via compact bulk optics for significantly reducing the number of components resulting in the system comprising:

a signal source having a frequency (ω)

a first spatial light amplitude modulator(SLM);

a first laser light source modulated by the signal source inputting to the first SLM and outputting a first output beam;

a second laser light source modulated by the signal source inputting to the first SLM and outputting a second output beam; and a beam combiner for combining the first output beam and the second output beam to a photosensor array that feeds to a transducer array.

10. The compact, low cost optical controller system for controlling transducer arrays of claim 9, further comprising:

a second SLM:

a third laser light source modulated by the signal source inputting to the second SLM and outputting a third output beam;

a third SLM;

a fourth laser light source modulated by the signal source inputting to the third SLM and outputting a fourth output beam, wherein the beam combiner combines the first output beam, the second output beam, the third output beam and the fourth ouput beam to the photosensor array that feeds to the transducer array.

11. The compact, low cost optical controller system for controlling transducer arrays of claim 10, wherein the signal source includes:

a signal having a frequency (ω) of approximately 100 GHz; and wherein the first laser light source, the second laser light source, the third laser light source and the fourth laser light source each include:

200 mw semiconductor laser diodes operating at approximately 780 nm.

12. The compact, low cost optical controller system for controlling transducer arrays of claim 10, wherein the first SLM, the second SLM, and the third SLM includes:

a first grey scale nematic liquid crystal(NLC) SLM;

a second grey scale nematic liquid crystal(NLC) SLM; and a third grey scale nematic liquid crystal(NLC) SLM.

13. The compact, low cost optical controller system for controlling transducer arrays of claim 10, wherein the first SLM, the second SLM, and the third SLM includes:

a first deformable mirror device(DMD);

a second deformable mirror device(DMD); and a third deformable mirror device(DMD).

14. The compact, low cost optical controller system for controlling transducer arrays of claim 10, wherein the first SLM, the second SLM, and the third SLM includes:

a first magnetooptic SLM;

a second magnetooptic SLM; and a third magnetooptic SLM.

15. The compact, low cost optical controller system for controlling transducer arrays of claim 10, wherein the first SLM, the second SLM, and the third SLM includes:

a first multiple quantum well device SLM;

a second multiple quantum well device SLM; and a third multiple quantum well device SLM.

16. The compact, low cost optical controller system for controlling transducer arrays of claim 10, wherein the first SLM, the second SLM, and the third SLM includes:

a first ferroelectric liquid crystal SLM for example, with macro-pixels for grey scaling;

a second ferroelectric liquid crystal SLM for example, with macro-pixels for grey scaling; and a third ferroelectric liquid crystal SLM for example, with macro-pixels for grey scaling.

* * * * *